US005653048A

United States Patent [19]

Jones et al.

[11] Patent Number: 5,653,048

[45] Date of Patent: Aug. 5, 1997

[54] WEAR ASSEMBLY FOR A DIGGING EDGE OF AN EXCAVATOR

[75] Inventors: Larren F. Jones, Aloha; Robert E. McClanahan, Portland, both of Oreg.; Hezekiah R. Holland, San Diego, Calif.

[73] Assignee: ESCO Corporation, Portland, Oreg.

[21] Appl. No.: 554,158

[22] Filed: Nov. 6, 1995

[51] Int. Cl.[6] ..... E02F 09/28

[52] U.S. Cl. ..... 37/452; 37/455; 37/450

[58] Field of Search ..... 37/446, 449, 450, 37/451, 452, 453, 454, 455, 456, 458; 172/772, 772.5, 713, 753; 403/16, 19, 20, 22, 374, 319

[56] References Cited

U.S. PATENT DOCUMENTS

| | | | |
|---|---|---|---|
| Re. 33,042 | 9/1989 | Emrich . | |
| 775,770 | 11/1904 | Herrod, Jr. | 37/456 X |
| 1,885,326 | 11/1932 | Brune | 37/456 X |
| 2,996,291 | 8/1961 | Krekeler . | |
| 3,345,765 | 10/1967 | Petersen | 37/449 |
| 3,357,117 | 12/1967 | Petersen | 37/449 |
| 3,371,437 | 3/1968 | Wilson et al. . | |
| 3,388,488 | 6/1968 | Duplessis . | |
| 3,426,459 | 2/1969 | Petersen | 37/446 X |
| 3,537,735 | 11/1970 | Hawk | 403/16 |
| 3,841,007 | 10/1974 | Howarth et al. . | |
| 3,896,569 | 7/1975 | Thompson et al. . | |
| 3,919,792 | 11/1975 | Hahn et al. . | |
| 3,974,579 | 8/1976 | Black et al. . | |
| 4,205,469 | 6/1980 | Johansson et al. . | |
| 4,233,761 | 11/1980 | Ryerson . | |
| 4,267,653 | 5/1981 | Hahn et al. . | |
| 4,317,300 | 3/1982 | Emrich et al. | 37/456 X |
| 4,433,496 | 2/1984 | Jones et al. | 37/456 |
| 4,577,423 | 3/1986 | Hahn . | |
| 4,748,754 | 6/1988 | Schwappach . | |
| 4,899,830 | 2/1990 | Maguina-Larco | 37/455 X |
| 4,965,945 | 10/1990 | Emrich . | |
| 5,005,304 | 4/1991 | Briscoe et al. | 37/451 |
| 5,056,243 | 10/1991 | Sprunger et al. | 37/453 |
| 5,063,695 | 11/1991 | Briscoe et al. | 37/451 |
| 5,063,696 | 11/1991 | Smith | 37/451 X |
| 5,088,214 | 2/1992 | Jones . | |
| 5,241,765 | 9/1993 | Jones et al. . | |
| 5,325,615 | 7/1994 | Hutchins et al. | 37/454 X |
| 5,337,495 | 8/1994 | Pippins | 37/452 X |
| 5,410,826 | 5/1995 | Immel et al. | 37/455 X |
| 5,417,518 | 5/1995 | Bierwith | 403/374 |
| 5,438,774 | 8/1995 | Fletcher et al. . | |
| 5,452,529 | 9/1995 | Neuenfeldt et al. | 403/374 X |

FOREIGN PATENT DOCUMENTS 2111558 7/1983 United Kingdom .

*Primary Examiner*—Terry Lee Melius
*Assistant Examiner*—Victor Baton
*Attorney, Agent, or Firm*—Banner & Witcoff, Ltd.

[57] ABSTRACT

A wear assembly for attaching to a digging edge of an excavator includes a boss, a wear member and a lock. The boss is fixed to the excavator and defines a T-shaped coupling structure. The adapter includes a rearwardly extending mounting leg and a forwardly extending working end. The leg includes a T-shaped slot adapted to be received over the T-shaped structure of the boss. The adapter leg further includes an opening for receiving a lock. The lock includes an adjustment assembly for eliminating any looseness which may exist between the adapter and the boss.

54 Claims, 8 Drawing Sheets

WEAR ASSEMBLY FOR A DIGGING EDGE OF AN EXCAVATOR

FIELD OF THE INVENTION

The present invention pertains to a wear assembly for the digging edge of excavating equipment, and in particular, to an adapter which is mechanically attached to such excavating equipment.

BACKGROUND OF THE INVENTION

Excavating teeth and other wear members have long been mounted along the digging edge of buckets and other excavating equipment to break up the ground and enhance the digging operation. As can be appreciated, the wear members used along the digging edge are often placed in harsh working conditions and are thus subjected to a high degree of wearing.

In order to minimize the size of the part needing frequent replacement, excavating teeth are ordinarily formed as a plurality of integrally connected parts. An excavating tooth usually comprises an adapter, a point, and a lock pin for securing the point to the adapter. The adapter has a rear mounting end which is configured for attachment to the digging edge of an excavator and a forwardly projecting nose for mounting the point. The point is a tapered member provided with a forward earth-penetrating end and a rearwardly opening socket adapted to be received over the adapter nose. Although the points wear out more frequently, the adapters are also subjected to wearing and periodic replacement. As can be appreciated, the adapters must not only be capable of being firmly secured to the excavator to prevent undesired loss of the tooth during use, but it is desirable that they also be capable of being readily removed and installed by operators in the field.

A number of different approaches have been developed for securing wear members, such as adapters, to the digging edge of a bucket. U.S. Pat. No. 4,577,423 to Hahn provides an example of an adapter that is welded to the lip of a bucket. As to be expected, welding functions to securely attach the adapter to the bucket. However, the replacement of welded adapters is typically performed at a shop rather than in the field. The time and difficulty required to remove and install such welded adapters has proven to be a significant deterrent.

U.S. Pat. No. 4,267,653 to Hahn et al. describes an example of a mechanically attached adapter. As shown in this patent, mechanically attached adapters are frequently held to a bucket by the combination of a C-shaped clamp and a wedge. The wedge must be fit very tightly between the clamp and the adapter in order to securely hold the adapter to the bucket. Typically, the wedge is inserted into the assembly by repeated blows with a heavy sledge hammer. As can be appreciated, this is an onerous and time-consuming task for field workers, especially to achieve the final inch of movement needed to mount the assembly. Further, the wedge even when tightly inserted often becomes loose under heavy loading, which thus risks loss of the tooth. Finally, these assemblies require a hole to be formed in the bucket lip, which reduces the lip's strength and integrity.

U.S. Pat. No. 5,088,214 to Jones discloses another arrangement for mechanically attaching a wear member to the lip of a bucket. According to this construction, the wear member is matingly slipped over a T-shaped boss that has been welded to the bucket lip. A rigid locking block is fit within an opening defined in the top of the wear member to prevent undesired removal of the wear member from the lip. While this construction avoids the formation of a hole in the bucket lip, it is not suitable for use in attaching all types of wear members to any kind of bucket. For instance, larger buckets provided with beveled lips tend to generate large forces on an adapter which could in some circumstances cause instability in the mounting assembly. Further, the assembly lacks means for eliminating looseness that may exist between the wear member and the boss.

SUMMARY OF THE INVENTION

The wear assembly of the present invention enables the wear member to be securely attached to the digging edge of an excavator without the need for welding of the wear member or, in the preferred construction, forming a hole in the excavator's edge. Moreover, the assembly has sufficient stability to amply support adapters on a bucket lip formed with a beveled ramp. Nevertheless, despite the durability of the wear assembly, the wear members can still be easily removed or installed when replacement of the member becomes necessary.

In accordance with one aspect of the invention, a wear assembly includes a wear member which releasably attaches to a boss that is fixed to an excavator. The wear member includes a leg which extends rearwardly over the front edge of the excavator. A T-shaped structure is formed along the inner side of the leg for attachment to the boss. The complementary T-shaped coupling structures of the wear member and the boss prevent dislodgement of the wear member under load. The wear member also has front and rear bearing surfaces for resisting the applied loads during use.

In another aspect of the present invention, the boss is formed with a first surface which lies against the excavator and a second surface which forms a T-shaped coupling structure for receiving a wear member. The boss further includes a front bearing face for bracing the wear member and a rear bearing face for abutting a lock member to prevent removal of the wear member. In the preferred construction, a clamp section is formed along the first surface to wrap about the front digging edge of the excavator.

In accordance with another aspect of the invention, an opening for receiving a lock is formed through the leg of the wear member. The opening has a generally T-shaped configuration with a stem portion and a cross portion. The stem portion extends longitudinally from the rear end of the leg to the lateral cross portion of the opening. The body of the lock sets between the rear end of the boss and the rear wall of the cross portion in order to prevent removal of the wear member from the boss. An adjustment assembly extends through the body to eliminate any looseness which may exist between the wear member and the boss.

In accordance with another aspect of the invention, a deflector can be fixed to the excavator at a position behind the wear member. The removal of a wear member from the boss can frequently be a difficult task due to the compaction of fines around the parts. However, a lock member with an adjustment assembly can be easily used with a deflector to slide the wear member forwardly from the boss.

BRIEF DESCRIPTION OF THE INVENTION

DETAILED DESCRIPTION OF THE INVENTION

The present invention pertains to a wear member, such as an adapter, which is mechanically attached to the digging edge of an excavator. While wear members in accordance with the present invention can be secured to a number of different excavators, the present application for illustration purposes discusses only the use of adapters secured to an excavating bucket. Further, operation of the equipment will cause the present wear assemblies to assume many different orientations. Nevertheless, for purposes of explanation, the components of the wear assemblies are at times described in regard to relative directions such as up and down. These directions should be understood with respect to the orientation of the wear assembly as shown in FIG. 2, unless stated otherwise.

Figure 2:
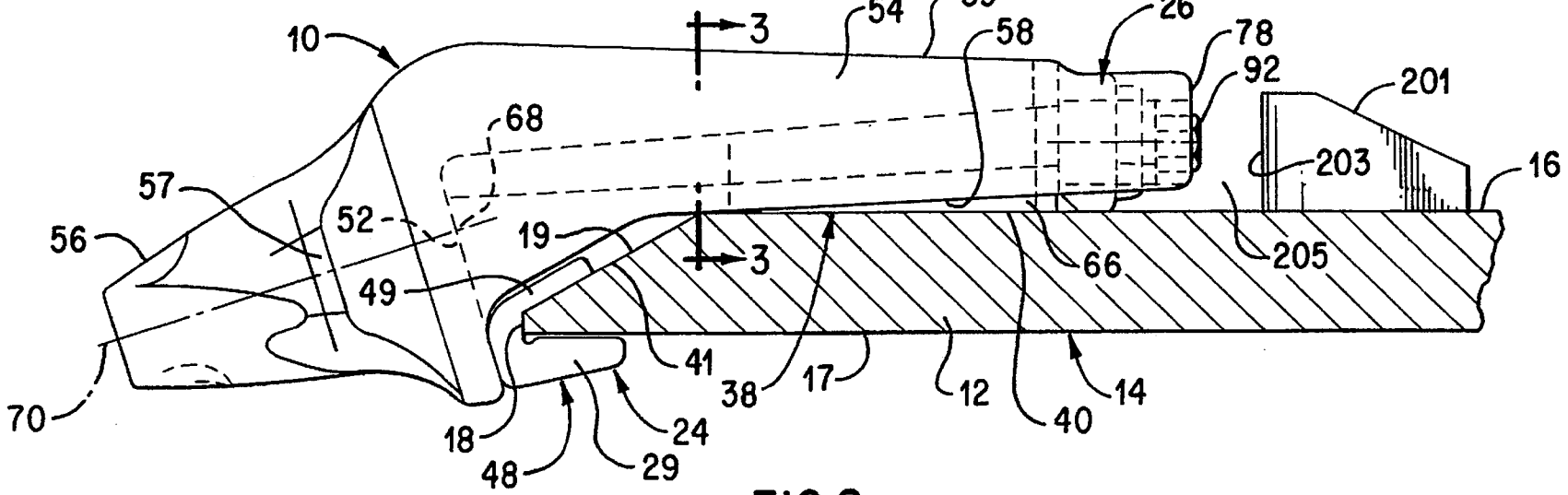
FIG. 2 is a side elevational view of the wear assembly.
Figure 3:
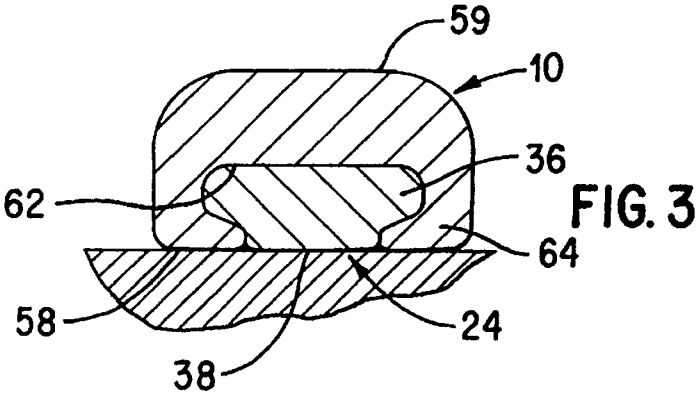
FIG. 3 is a cross-sectional view taken along line 3—3 in FIG. 2.

An adapter 10 in accordance with the present invention is particularly designed for attachment to the front lip 12 of a bucket 14 (FIG. 2). The lip includes an upper or inside surface 16, a lower or outside surface 17, a front edge face 18, and a beveled ramp 19 that interconnects inside surface 16 with front edge face 18. Adapter 10 is secured to lip 12 through the use of a boss 24 and a lock member 26.

Boss 24 is generally a J-shaped member with a pair of legs 28, 29 which wrap around the lip of bucket 14 (FIGS. 4–8). Upper leg 28 has a body 32 and a lateral flange 34 which together form a T-shaped structure along the top of the leg. The rear end of leg 28 forms a substantially flat, vertical wall 36 which functions to abut lock member 26 as discussed below; although wall 36 could have a concave or convex shape. The inner surface 38 of leg 28 includes a rear segment 40 which preferably lies against inside surface 16 and a front segment 41 which lies against beveled ramp 19. Nonetheless, in some circumstances, leg 28 may be fixed to the outside surface of the excavating equipment.

Figure 4:
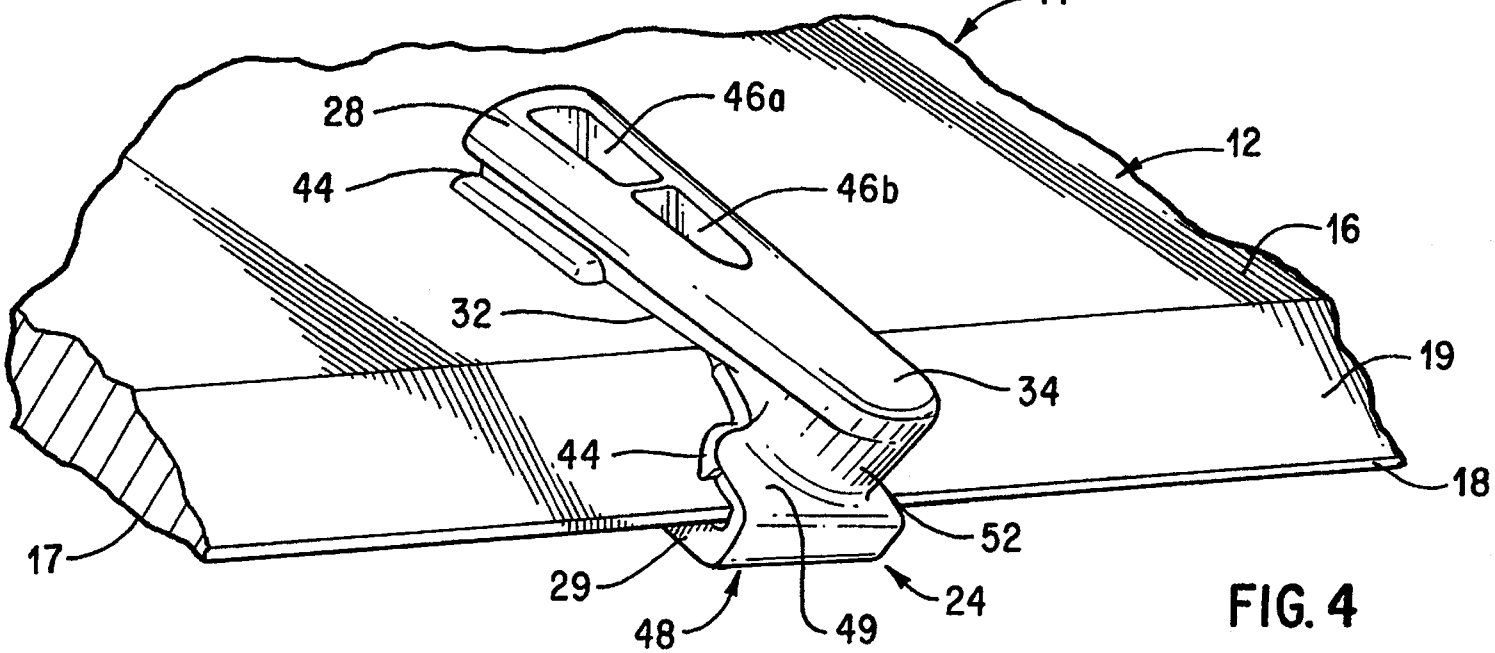
FIG. 4 is a perspective view of a boss in accordance with the present invention.
Figure 5:
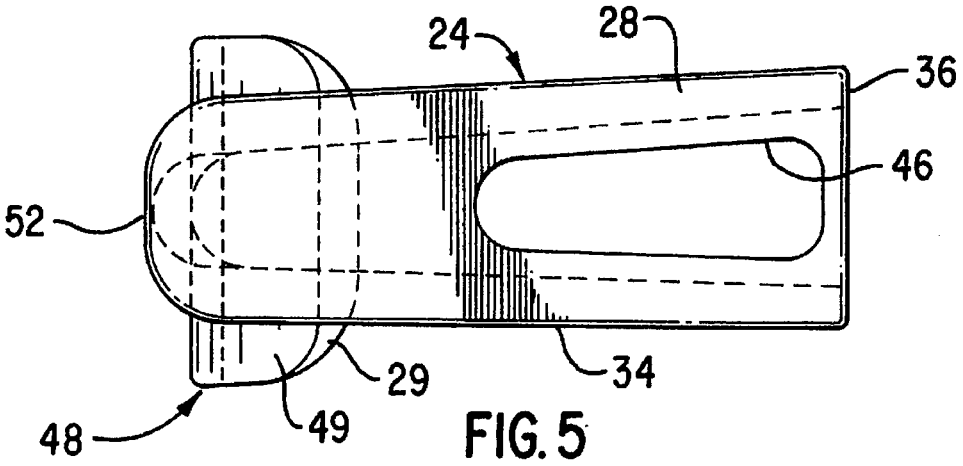
FIG. 5 is a top plan view of the boss.
Figure 6:
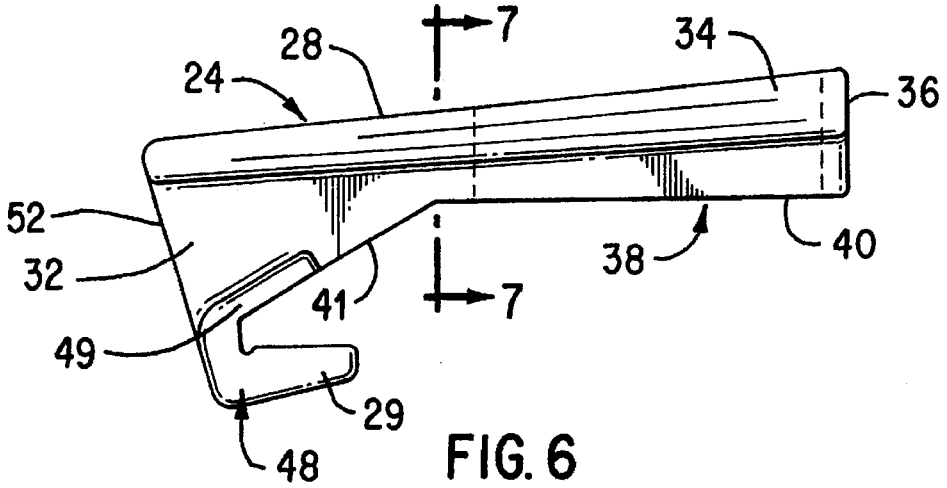
FIG. 6 is a side elevational view of the boss.
Figure 7:
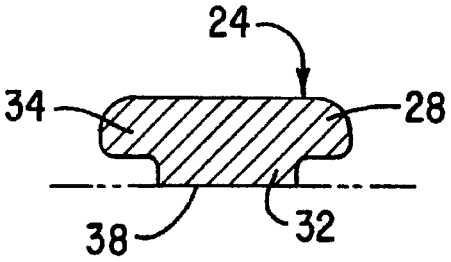
FIG. 7 is a cross-sectional view of the boss taken along line 7—7 in FIG. 6.
Figure 8:
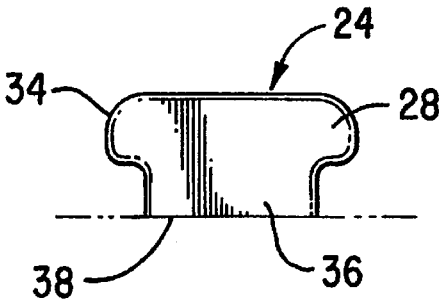
FIG. 8 is an rear elevational view of the boss.

In the preferred construction, weld beads 44 are secured along at least portions of the rear and front segments 40, 41 to fixedly attach the boss to the bucket lip (FIG. 4). At least one hole 46 is preferably provided through upper leg 28 to define an additional area for welding the boss to the bucket (FIGS. 5 and 6). A pair of holes 46*a*, 46*b* (or other arrangements) could alternatively be formed if desired. For illustration purposes, this arrangement of holes has been shown in the perspective view of the boss (FIG. 4). Since the boss is substantially enveloped by the adapter, as described below, wearing of the boss is minimized. As a result, the boss requires only infrequent replacement. Welding of the boss to the lip is therefore not a significant deterrent to the operators in the field, unlike the welding of adapters which need frequent replacement. Alternatively, the boss can be fixed to the lip of the bucket by other means, such as bolting or being integrally cast with the lip construction. Also, particularly with cast bosses, lower leg 29 can be omitted.

To form the T-shaped construction, body 32 of boss 24 is narrower than flange 34. The lower portion of leg 28, however, again widens at the front end of the boss to form with leg 29 a clamping section 48. In the preferred construction, the width of clamping section 48 has substantially the same width as adapter 10. Clamping section 48 includes a top brace 49 and lower leg 29 intersected to form a generally V-shape configuration. The widened clamping section provides increased support for holding the boss to the bucket, and enhanced support in resisting loads imposed on the adapter. Further, lower leg 29 is short and positioned close to adapter 10 so as to limit the exposure and wearing of the member. Although not illustrated, lower leg 29 is in the preferred construction welded to outside surface 27. The front of boss 24 is shaped to define a bearing face 52 that matingly abuts adapter 10 as discussed below. Due to the connection of body 32 with flange 34 and with clamping section 48, bearing face 52 has a generally I-shaped configuration (FIG. 4).

Adapter 10 includes a rearwardly extending leg 54 and a forwardly projecting nose 56 (FIGS. 1–3 and 9–12). Nose 56 is preferably formed as disclosed in U.S. Pat. No. 4,965,945 to Emrich, which is hereby incorporated by reference. Nevertheless, many other nose structures could be used as desired. In use, the socket defined in the point (not shown) is matingly received over the nose. In the illustrated embodiment, a lock pin (not shown) is passed along shoulder 57 to secure the point (not shown) to the adapter.

Adapter 10 includes only a single leg 54 which preferably extends along the inside surface of the bucket. Ordinarily, the outside leg of atypical bifurcated adapter experiences much more wearing than the inside leg. By eliminating the need for a leg along the outside of the bucket, the adapters of the present invention generally enjoy a longer usable life. Nonetheless, in some circumstances, leg 54 can be secured along the outside surface of the excavating equipment. Leg 54 has an inner surface 58 and an outer surface 59. A T-shaped slot 62 opens along the inner surface 58 to matingly engage with the T-shaped configuration defined along the top of boss 24 (FIGS. 3, 11, 12 and 18). To install adapter 10 on a bucket, the adapter is slid rearwardly onto boss 24 such that slot 62 is received over and around flange 34. As an alternative, in certain circumstances, the T-shaped structures of the boss and the adapter may be formed as rail segments with spaced apart gaps therebetween as disclosed in U.S. Pat. No. 5,241,765 to Jones et al., which is hereby incorporated by reference. As discussed in this patent, the use of segments enables the wear member to be installed and removed with minimum longitudinal sliding of the adapter along the boss.

As can be appreciated, flange 34 prevents movement of the adapter upward and away from inside surface 16 of bucket 14. While the marginal edges 64 of inner surface 58 generally follow the contour of bucket lip 12, the marginal edges do not have any significant engagement with the lip. In the preferred construction, a gap 66 is formed between most of the marginal edges 64 of adapter 10 and bucket 14 to permit sufficient space for the placement of weld beads 44.

Figure 10:
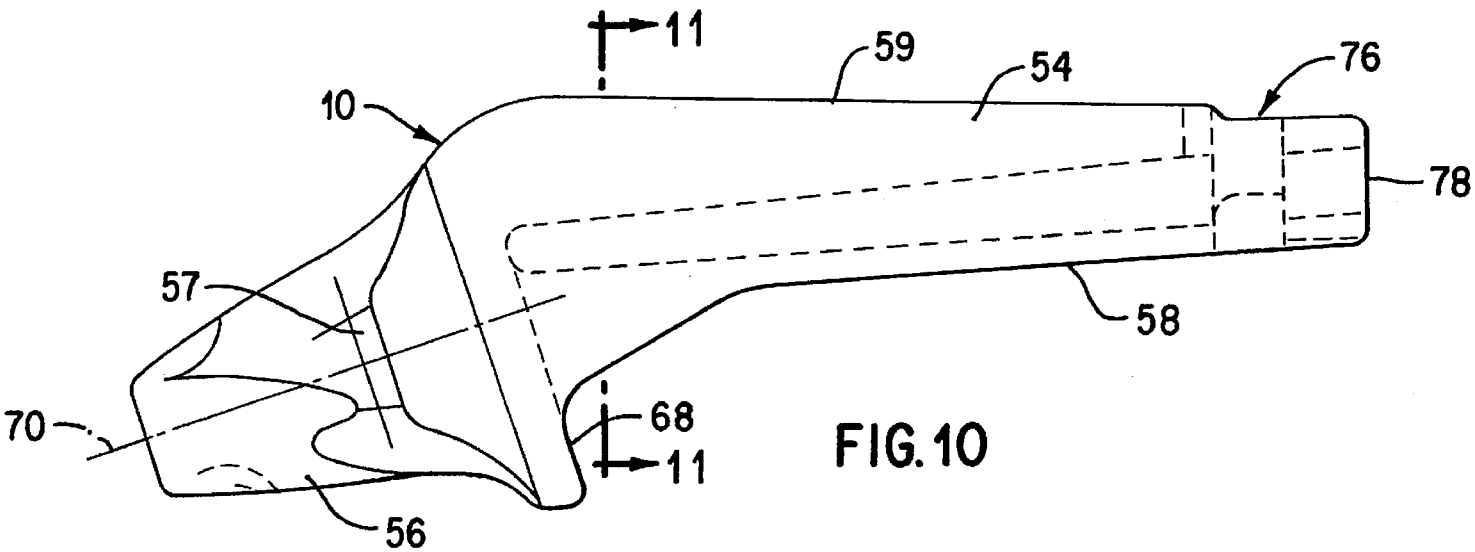
FIG. 10 is a side elevational view of the adapter.

A bearing face 68 is positioned at the front end of slot 62 to abut against bearing face 52 at the front of boss 24 (FIGS. 2 and 10). In the preferred construction, bearing faces 52, 68 are oriented to be substantially perpendicular to the axis 70 of nose 56. With this arrangement, the magnitude of the moment forces to be resisted by the bearing surfaces can be minimized. Nevertheless, the angular orientation of bearing surfaces 52, 68 could be varied considerably depending upon the desired application. Further, bearing faces 52, 68 both preferably extend below nose 56 in order to better resist downwardly applied forces on the front of the point. Moreover, this downward extension of the bearing surfaces forms a front covering for clamp section 48 of boss 24 which, in turn, reduces wearing of the boss. Finally, though bearing faces 52, 68 are generally planar, they could also be concave or convex in shape.

Figure 1:
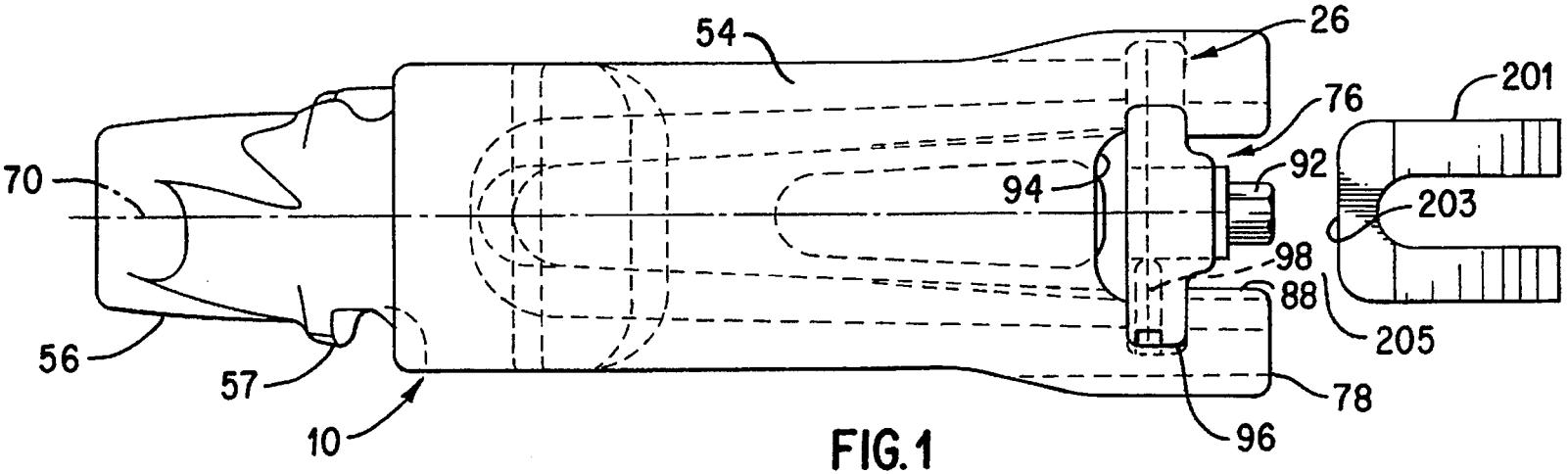
FIG. 1 is top plan view of a wear assembly in accordance with the present invention.
Figure 9:
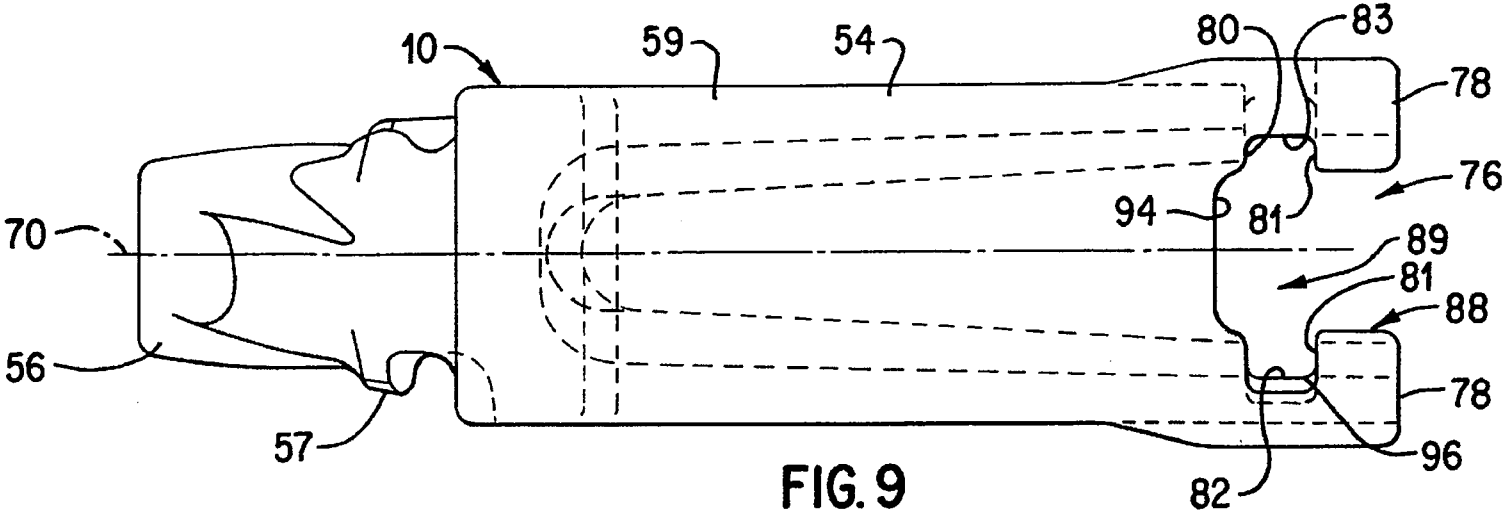
FIG. 9 is a top plan view of an adapter in accordance with the present invention.

An opening 76 is provided in leg 54 to extend from outer surface 59 to inner surface 58 and communicate with slot 62 (FIGS. 1 and 9). Opening 76 is positioned near rear end 78 of leg 54, and rearward of rear bearing face 36 of boss 24 when adapter 10 is assembled on the boss. In the preferred embodiment, opening 76 has a generally T-shaped configuration which includes a stem portion 88 and a cross portion 89. The cross portion is defined by a pair of opposing front and rear walls 80, 81 and a pair of side walls 82, 83. Stem portion 88 extends longitudinally between cross portion 89 and rear wall 78. As discussed more fully below, stem portion 88 provides clearance for the adjustment assembly 92 of lock member 26. Front wall 80 of opening 76 also preferably includes a central recess 94 to provide clearance for the front of the adjustment assembly as needed.

Figure 12:
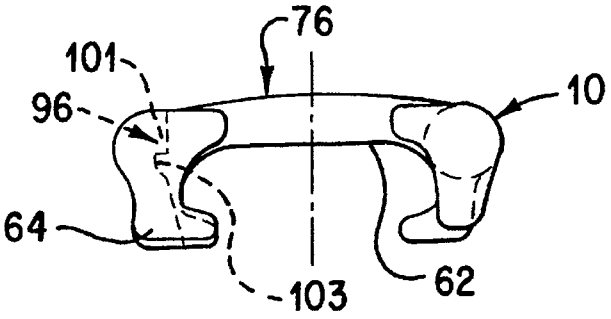
FIG. 12 is a rear elevational view of the adapter.
Figure 11:
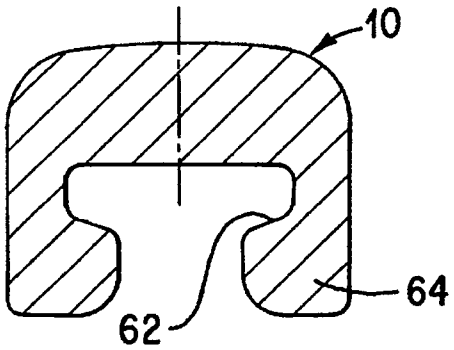
FIG. 11 is a cross-sectional view of the adapter taken along line 11—11 in FIG. 10.
Figure 18:
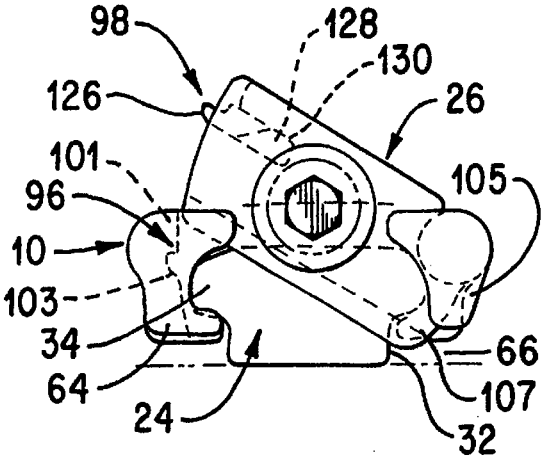
FIG. 18 is a rear elevational view of the lock member partially inserted into an adapter assembly in accordance with the present invention.

One of the side walls 82 of the cross portion of opening 76 defines a keeper 96 to cooperate with a latch 98 for releasably retaining lock member 26 in the opening (FIGS. 12 and 18). Keeper 96 is preferably formed by a tab 101 which overlies a recess 103 adapted to receive latch 98. The other side wall 83 of opening 76 has an arcuated configuration which conforms with the arc of a circle to form a pivot support for inserting and removing the lock. Leg 54 includes a space 105 below side wall 83 for receiving one end 107 of lock member 26 as described below.

Figure 14:
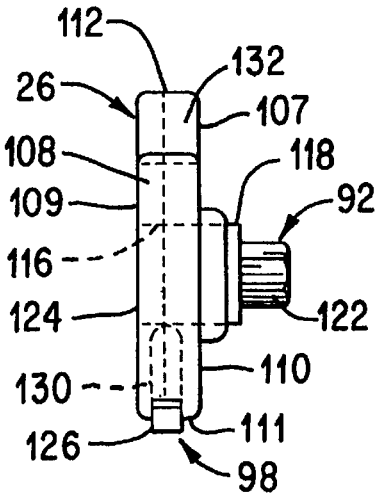
FIG. 14 is a top plan view of a lock member in accordance with the present invention.
Figure 15:
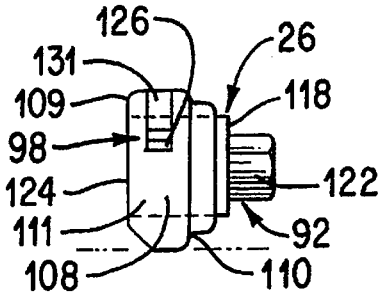
FIG. 15 is a side elevational view of the lock member.
Figure 16:
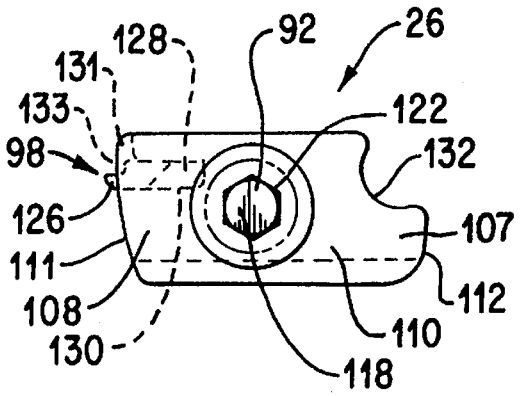
FIG. 16 is a rear elevational view of the lock member.

Lock member 26 functions to prevent adapter 10 from being slid axially off boss 24. Lock member 26 has a rigid block-shaped body 108 defined by a front wall 109, a rear wall 110, a first end wall 111, and a second end wall 112 (FIGS. 14–16). Body 108 of lock 26 is received into cross portion 89 of opening 76 such that its front wall 109 opposes rear wall 36 of boss 24, and its rear wall 110 opposes rear wall 81 of adapter 10 (FIG. 1). This engagement structure effectively prevents the adapter from being moved forwardly along the boss.

Lock member 26 further includes a latch 98 (FIGS. 14, 16 and 18). Latch 98 preferably includes a rigid tang 126 and an elastomeric member 128. Latch 98 is mounted within an opening 130 in end wall 111 such that tang 126 projects outward therefrom. To facilitate removal of the lock from opening 76, a groove 131 is preferably defined in lock 26 along the top of end wall 111 to enable a tool (e.g., a screw driver) to engage a shoulder 133 on tang 126 and retract latch 98 from keeper 96 (FIGS. 15 and 16). Second end wall 112 includes an arcuate depression 132 which is adapted to matingly engage the arcuated end wall 83, and enable lock member 26 to pivotally swing into and out of opening 76. When lock member 26 is inserted into opening 76 end portion 107 is fit into space 105 to provide a larger abutting area (FIG. 18).

Lock 26 further includes an adjustment assembly 92 for eliminating any looseness that may exist between the adapter and the boss (FIGS. 14–16). In the preferred construction, adjustment assembly 92 includes a threaded bore 116 that extends through lock member 26 to receive a threaded plug 118. Plug 118 includes flats 122 on its rear end to facilitate engagement with a wrench or the like and a front bearing face 124. In use, plug 118 is advanced through bore 116 until bearing face 124 engages rear wall 36 of boss 24 and rear wall 110 of lock member 92 abuts rear wall 81 of opening 76. Plug 118 is preferably not tightened beyond engagement of the abutting walls to avoid unnecessary loading of the plug 118. Moreover, since the plug is only loaded with compressive forces, the assembly has considerable durability and strength. As the adapter and boss wear, looseness may develop between the two parts. To eliminate this looseness, plug 118 is advanced forwardly until front face 124 of plug 118 again abuts rear wall 36 of boss 24 and rear wall 110 abuts rear wall 81 of opening 76.

Figure 17:
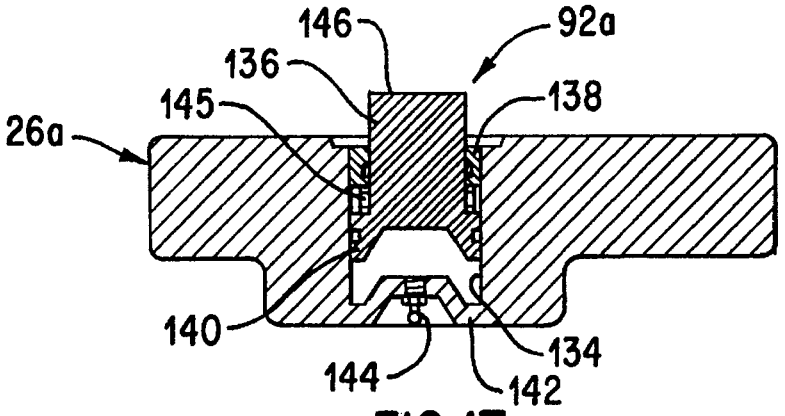
FIG. 17 is a sectional view of an alternative lock member in accordance with the present invention.

Alternatively, plug 118 can be replaced with an adjustment assembly **92*a* which relies upon fluid pressure to eliminate any existing looseness in the assembly (FIG. 17). More specifically, in this embodiment, lock member 26*a* includes a cylindrical cavity 134 in lieu of threaded bore 116. A piston 136 is slidably received in cavity 134 for movement toward and away from rear wall 36 of boss 24. A retaining ring 138 is threadedly attached in cavity 134 to form a stop against which annular shoulder 140 of piston 136 engages upon maximum extension. A rear wall 142 closes the cavity on its rear end and supports grease fitting 144. Grease fitting 144 is preferably set in a recess 143 for protection. Grease or other fluid is fed into cavity 134 to drive piston 136 forward. A coil spring 145 is received around piston 136 to retract the piston when the grease is drawn out of cavity 134**.

Figure 13:
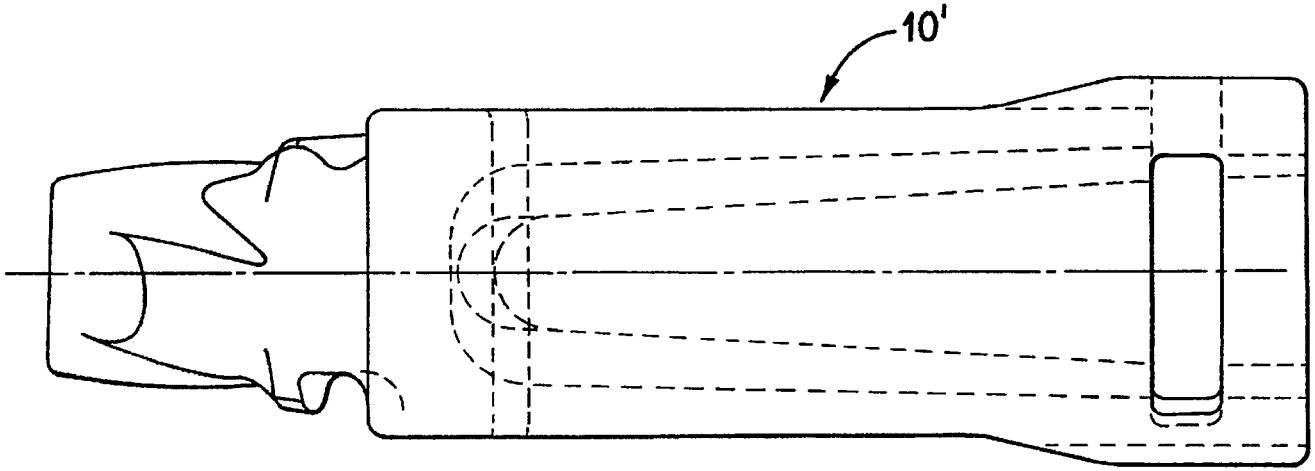
FIG. 13 is a top plan view of an alternative adapter in accordance with the present invention.
Figure 19:
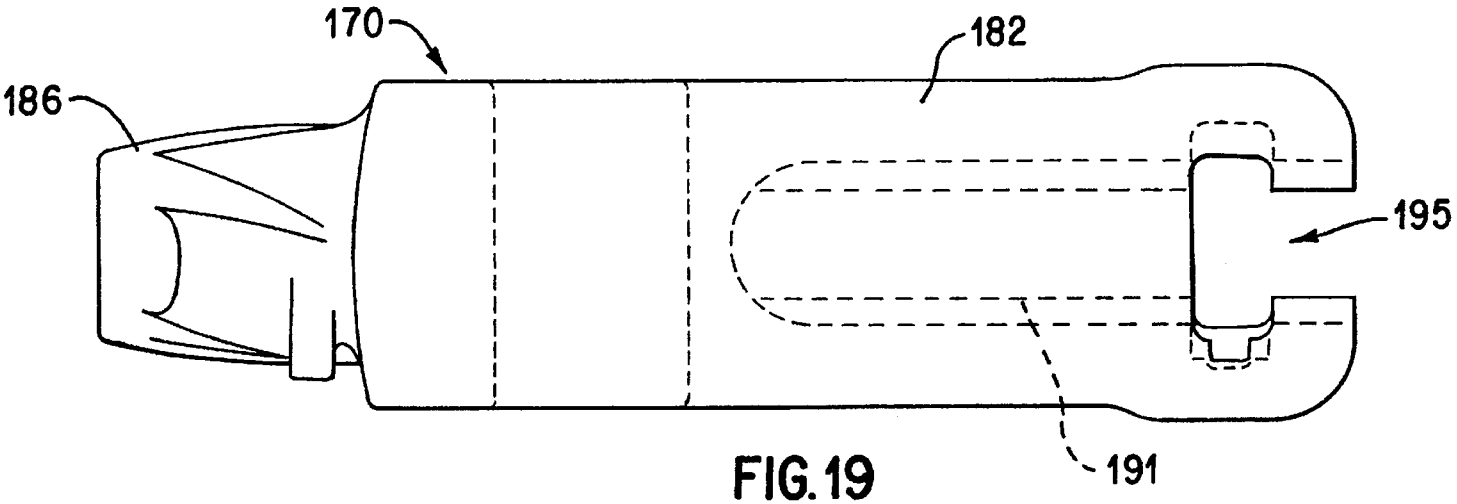
FIG. 19 is a top plan view of another alternative adapter in accordance with the present invention.
Figure 20:
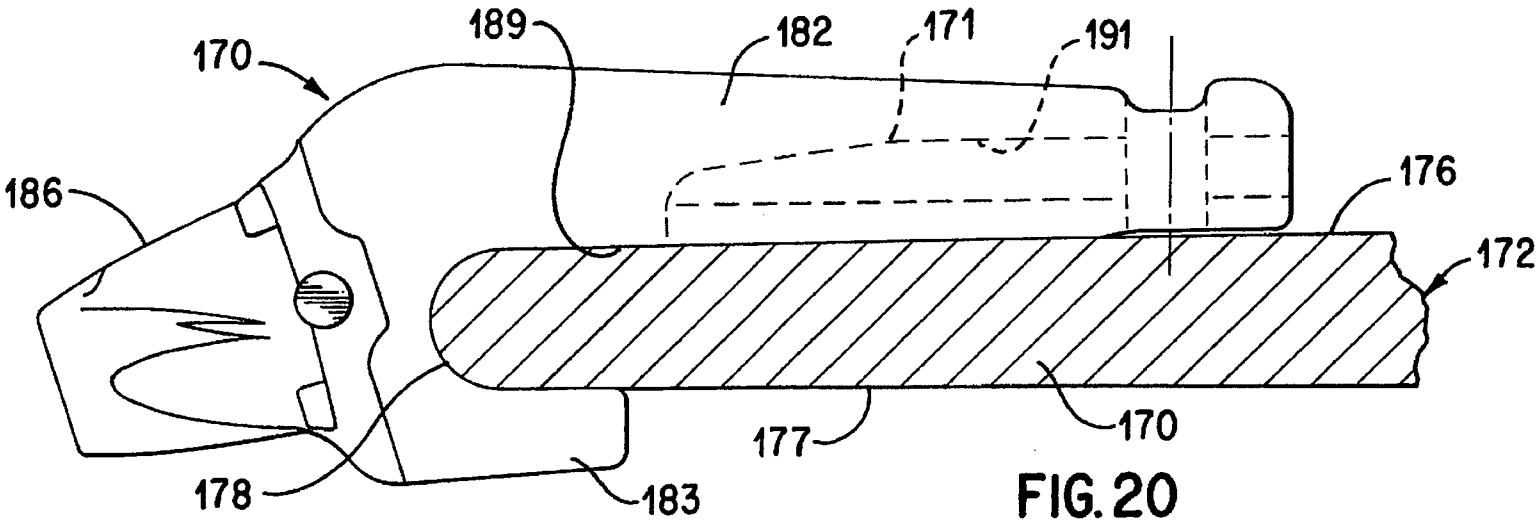
FIG. 20 is a side elevational view of the other alternative adapter on the digging edge of an excavator.

The use of a lock member 26, **26*a* with an adjustment assembly 92, 92*a* can also be used with other adapter constructions. For instance, with repositioning of the grease fitting, lock 26*a* could be set in an opening of an adapter 10' without a stem portion (FIG. 13). As another example, the wear assembly can include an adapter 170 and a boss 171 which attaches to a bucket 172 (FIGS. 19 and 20). The bucket lip 174 includes generally parallel inside and outside surfaces 176, 177, and a rounded front edge 178**.

Adapter 170 includes a pair of legs 182, 183 which extend along inside surface 176 and outside surface 177, respectively, and a nose 186 (FIGS. 19 and 20). Although nose 186 preferably has the same construction as nose 56 of adapter 10, it is shown with a nose in accordance with U.S. Pat. No. RE33042, incorporated herein by reference, to illustrate that different noses can be used. Top leg 182 has a lower surface 189 that lies against inside surface 176 of lip 174. A T-shaped slot 191 opens in lower surface 189 to receive a complementary T-shaped boss 171. The rear end of leg 182 includes an opening 195 which has the same construction as opening 76.

Figure 21:
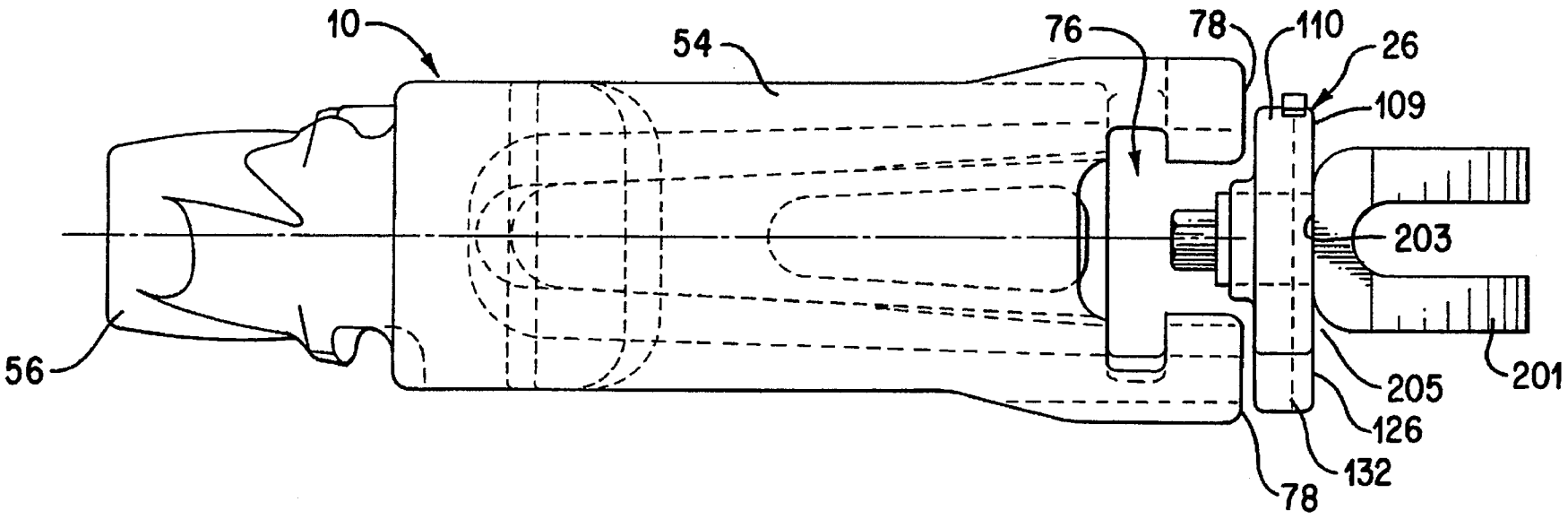
FIG. 21 is a top plan view of a wear assembly in accordance with the present invention with the lock member positioned for effecting removal of the wear member.

A deflector 201 (FIGS. 1–2 and 21) is preferably secured to inside surface 16 of bucket 14 (or alternatively bucket 172). Deflector 201 is preferably a U-shaped member provided with a forward bracing surface 203; although other structural members could be used. The deflector is used to ease the removal of adapter 10 in the field. In particular, lock 26 (or **26*a*) is removed from opening 76, reversed, and set within the gap 205 defined between rear end 78 of adapter 10 and bracing surface 203 of deflector 201. The plug 118 is then advanced so that its bearing face 124 pushes against deflector 201 to move lock member 26 forwardly into engagement with rear end 78 of adapter 10. Continued advancement of plug 118 then functions to push adapter 10 from boss 24. Alternatively, other expansion devices (e.g., a turnbuckle) could be used with the deflector in lieu of lock 26**.

While use of a lock with an adjustment assembly is desired, it is not essential to the present invention. The adapters 10, 170 can be amply secured to boss 24, 171 by a rigid lock without an adjustment assembly (not shown) that simply prevents forward movement of the adapter. Under these conditions, the lock member and corresponding opening would be essentially the same as discussed in U.S. Pat. No. 5,088,214 to Jones, which is hereby incorporated by reference. An example of such an adapter 10' is shown in FIG. 13. Nevertheless, a lock without an adjustment assembly could still be used in openings 76, 195.

The above-discussion concerns the preferred embodiments of the present invention. Various other embodiments as well as many changes and alterations may be made without departing from the spirit and broader aspects of the invention as defined in the claims.

We claim:

1. A wear assembly for attachment to a digging edge of an excavator, the digging edge having an inside face and an outside face, said wear assembly comprising:

a boss having a first surface adapted to be fixed to the digging edge, a second surface adapted to be positioned remote from the digging edge and having a T-shaped structure, and a bearing face extending between said first and second surfaces;

a wear member having at least one rearwardly extending leg and a forwardly projecting working end, said leg having a T-shaped structure releasably coupled to said T-shaped structure of said boss, said leg further including an opening extending therethrough; and a rigid lock received into said opening, said lock having a first face adapted to oppose and engage said bearing face of said boss and a second face adapted to oppose and engage a wall of said opening whereby said lock secures said wear member to said boss, said lock further including an adjustment assembly selectively movable to vary the relative positions of said first and second faces to eliminate looseness which may exist in mounting said wear member to the digging edge.

2. A wear assembly in accordance with claim 1, in which said opening has a generally T-shaped configuration with a stem portion that extends longitudinally and opens in said rear end and a lateral cross portion which includes said wall to oppose said lock.

3. A wear assembly in accordance with claim 1, in which said lock includes a body and said adjustment assembly includes a threaded bore extending through said body and a threaded plug operatively received into said bore, wherein said plug includes the first adapted to engage said bearing face of said boss.

4. A wear assembly in accordance with claim 1, in which said lock includes a body and said adjustment assembly includes a bore extending substantially through said body and a piston axially movable in said bore under fluid pressure, wherein said piston includes the first face adapted to engage said bearing face of said boss.

5. A wear assembly in accordance with claim 1, further including a deflector fixed to the digging edge rearward of said boss, said lock member being positionable between said deflector and said wear member to move said adapter forwardly along said boss upon advance of said adjustment assembly.

6. A wear assembly for attachment to a digging edge of an excavator, the digging edge having an inside face and an outside face, said wear assembly comprising:

a boss having a first surface adapted to be fixed to the digging edge, a second surface adapted to be positioned remote from the digging edge and having a T-shaped structure, and rear and front bearing faces extending between said first and second surfaces;

a wear member comprising a rear mounting end and a forwardly projecting working end, said working end having a longitudinal axis, said mounting end including a leg having a longitudinal axis inclined relative to said longitudinal axis of said working end and adapted to extend rearwardly over the digging edge, said leg having an inner surface adapted to face the digging edge and a T-shaped structure extending longitudinally along said inner surface for coupling to said T-shaped structure of said boss, a bearing face extending transversely to said T-shaped coupling structure and generally perpendicular to said longitudinal axis of said working end whereby said bearing face abuts said front bearing face of the boss, and a lock receiving opening extending through said leg and in communication with said T-shaped structure of said wear member; and a lock received into said opening to oppose said rear bearing face of said boss and a wall of said opening to thereby secure said wear member to said boss.

7. A wear assembly in accordance with claim 6, in which said working end includes a nose for mounting a point of an excavating tooth.

8. A wear assembly in accordance with claim 7, wherein said nose includes a mounting portion which is enveloped by the point for securing the point to the digging edge, and wherein said bearing face extends in a direction away from said T-shaped coupling structure to a position beyond said mounting portion of said nose.

9. A wear assembly in accordance with claim 6, further including a deflector fixed to the digging edge spaced rearward of said boss such that expansion means is positionable between said deflector and said adapter for moving said adapter forwardly along said boss.

10. A wear member for attachment to a digging edge of an excavator, the digging edge having an inside face and an outside face, said wear member comprising a rear mounting end and a forwardly projecting working end, said mounting end including a leg adapted to extend rearwardly over the digging edge, said leg having an inner surface adapted to face the digging edge and a T-shaped coupling structure extending longitudinally along said inner surface for coupling to a boss fixed to the digging edge, a bearing face in communication with said T-shaped coupling structure and extending transversely to said T-shaped coupling structure in a direction generally away from said T-shaped coupling structure to a position beyond said inner surface at least approximately as far as the extension of said working end in the same direction whereby said bearing face is adapted to abut a front end of the boss, and a lock receiving opening extending through said leg in communication with said T-shaped coupling structure, said opening including a pair of longitudinal side walls, one of said side walls including a keeper for releasably retaining a lock.

11. A wear member in accordance with claim 10, in which said working end includes a nose for mounting a point of an excavating tooth.

12. A wear member in accordance with claim 11, in which said nose has a longitudinal axis and said bearing face is substantially perpendicular to said longitudinal axis.

13. A wear member in accordance with claim 12, in which said mounting end includes only a single rearwardly extending leg.

14. A wear member in accordance with claim 10, in which said mounting end includes only a single rearwardly extending leg.

15. A wear member in accordance with claim 10, in which said working end has a longitudinal axis and said bearing face is substantially perpendicular to said longitudinal axis.

16. A wear member in accordance with claim 10, in which said T-shaped coupling structure is a T-shaped slot.

17. A wear member in accordance with claim 10, in which said opening has a generally T-shaped configuration with a stem portion that extends longitudinally and opens in a rear end of said leg and a cross portion which extends laterally a greater distance the said stem portion.

18. A wear member in accordance with claim 10, in which said other of said pair of opening side walls is arcuated to form a pivot support for the lock.

19. A wear member in accordance with claim 10, in which said keeper includes a tab which overlies a recess in said one side wall.

20. A wear member for attachment to a digging edge of an excavator, the digging edge having an inside face and an outside face, said wear member comprising a rear mounting end and a forwardly projecting working end having a longitudinal axis, said mounting end including a leg adapted to extend rearwardly over the digging edge, said leg having a longitudinal axis which is inclined relative to said longitudinal axis of said working end, said leg having an inner surface adapted to face the digging edge and a T-shaped coupling structure extending longitudinally along said inner surface for coupling to a boss fixed to the digging edge, a bearing face extending transversely to said T-shaped coupling structure and substantially perpendicular to the longitudinal axis of said working end whereby said bearing face is adapted to abut a front end of the boss, and a lock receiving opening extending through said leg and in communication with said T-shaped coupling structure.

21. A wear member in accordance with claim 20, in which said working end includes a nose for mounting a point of an excavating tooth.

22. A wear member in accordance with claim 21, in which said bearing face extends beyond said nose in a direction away from said T-shaped coupling structure.

23. A wear member in accordance with claim 20, in which said working end is formed by tapering walls having rearward ends proximate said mounting end, and said bearing face extends in a direction away from said T-shaped coupling structure to a position beyond said rearward ends of said tapering walls.

24. A wear member in accordance with claim 20, in which said T-shaped coupling structure is a T-shaped slot.

25. A wear member in accordance with claim 20, in which said opening includes a pair of longitudinal walls, wherein one of said walls includes a keeper for releasably retaining a latch of a lock.

26. A wear member for attachment to a digging edge of an excavator, the digging edge having an inside face and an outside face, said wear member comprising a rear mounting end and a forwardly projecting working end, said mounting end including at least one leg adapted to extend rearwardly over the digging edge, said leg having an outer surface, an inner surface and a rear end wall, said inner surface being adapted to face said digging edge and having a T-shaped coupling structure for coupling to a boss fixed to the digging edge, and a lock receiving opening extending through said leg, said opening having a generally T-shaped configuration with a longitudinal stem portion opening in said rear end wall and a cross portion extending laterally beyond said stem portion.

27. A wear member in accordance with claim 26, in which said working end includes a nose for mounting a point of an excavating tooth.

28. A wear member in accordance with claim 26, in which said T-shaped coupling structure is a T-shaped slot.

29. A wear member in accordance with claim 26, in which one of said side walls of said opening includes a keeper for releasably retaining a latch of a lock.

30. A wear member in accordance with claim 29, in which said other of said pair of side walls of said opening is arcuated to form a pivot support for the lock.

31. A wear member in accordance with claim 29, in which said keeper includes a tab which overlies a recess in said one side wall.

32. A wear member in accordance with claim 26, in which said mounting end includes only a single rearwardly extending leg.

33. A wear member in accordance with claim 26, in which said mounting end includes a pair of rearwardly extending legs spaced apart to receive therebetween the digging edge.

34. A boss for attaching a wear member to a digging edge of an excavator, the digging edge having an inside face and an outside face, said boss comprising a first surface adapted to be fixed to the digging edge, and a second surface adapted to be positioned remote from the digging edge, said second surface having a longitudinally extending T-shaped coupling structure, said first surface having a clamping section adapted to wrap around the digging edge and engage front portions of the inside face and the outside face, and a front bearing face and a rear bearing face each extending between said first surface and said second surface.

35. A boss in accordance with claim 34, wherein said T-shaped coupling structure includes a body extending generally perpendicular to the digging edge and a lateral flange, and wherein said clamping section extends laterally beyond said body.

36. A boss in accordance with claim 35, in which said clamping section extends laterally beyond said flange.

37. A boss in accordance with claim 34, in which said front and rear bearing faces are generally planar.

38. A boss in accordance with claim 34, which further includes an opening extending from said first surface to said second surface to enable welding of said boss to the digging edge.

39. A boss in accordance with claim 34, in which said first surface includes a front segment and a rear segment, wherein said front segment extends at an inclination to said rear segment to engage a beveled ramp on the inside face of the digging edge.

40. A boss for attaching a wear member to a digging edge of an excavator, the digging edge having an inside face, an outside face and a beveled ramp, said boss comprising a first surface adapted to be fixed to the digging edge and a second surface adapted to be positioned remote from the digging edge, said first surface having a rear segment and a front segment inclined relative to one another, said front segment being adapted to be fixed to the beveled ramp of the digging edge, said second surface having a longitudinally extending T-shaped coupling structure, and a front bearing surface and a rear bearing face each extending between said first surface and said second surface.

41. A lock member for securing a wear member to a boss wherein the boss is fixed to a digging edge of an excavator, said lock member comprising a block shaped body having a rigid construction and including front and rear faces and a pair of side faces, one of said side faces including a latch adapted to cooperate with a keeper for retaining said lock member in a opening of the wear member, and an adjustment assembly having an longitudinal axis and extending through said body generally orthogonally to said front and rear faces, said adjustment assembly having a front bearing face that is axially movable to eliminate any looseness existing between the boss and the wear member.

42. A lock member in accordance with claim 41, in which said adjustment assembly includes a threaded bore extending through said body and a threaded plug operatively received into said bore, wherein said plug includes said front bearing face.

43. A lock member in accordance with claim 42, in which said plug further includes a plurality of flats to facilitate turning in said bore.

44. A lock member in accordance with claim 41, in which said adjustment assembly includes a bore extending substantially through said body and a piston axially movable in said bore under fluid pressure, wherein said piston includes said front bearing face.

45. A lock member in accordance with claim 41, in which the other of said side faces includes an arcuated depression which forms a pivot support.

46. A lock member in accordance with claim 41, in which said latch includes a rigid tang projecting outward from said one side face and an elastomeric member resiliently supporting said tang.

47. A method of removing a wear member from a boss fixed to a digging edge of an excavator, said method comprising:

providing a wear assembly including a boss fixed to the digging edge of an excavator, a deflector fixed to the digging edge rearward of said boss, a wear member, and a lock member, said boss and said wear member including complementary T-shaped structures coupled together to releasably hold said wear member to said boss, and said lock member preventing removal of said wear member from said boss when installed;

removing said lock member from said wear assembly;

providing an expansive force between said wear member and said deflector to force said wear member forwardly along said T-shaped structure of said boss; and removing said wear member from said boss.

48. A method in accordance with claim 47, wherein said lock member includes an adjustment assembly which is selectively movable, and wherein said adjustment assembly of said lock member is used to apply said expansive force.

49. A method in accordance with claim 48, wherein said adjustment assembly includes a piston which is advanced under fluid pressure to move said wear member.

50. A method in accordance with claim 48, wherein said adjustment assembly includes a threaded plug which is advanced to move said wear member.

51. A wear assembly for attachment to a digging edge of an excavator comprising:

a wear member having a rearwardly extending leg and a forwardly projecting working end, said leg having a longitudinal slot which opens in an inner side of said leg, said slot having an internal shoulder, and an opening extending through said leg and in communication with said slot, said opening including a bearing face;

a boss adapted to be fixed to the digging edge, said boss including a bearing face and a longitudinal tongue, said tongue being axially received into said slot of said wear member and including a shoulder to engage said internal shoulder of said slot to prevent relative movement between said wear member and said boss in directions other than longitudinal; and a rigid lock received into said opening and including a first face engaged with said bearing face of said opening, a second face engaged with said bearing face of said boss, and an adjustment assembly selectively movable to vary the relative positions of said first and second faces to eliminate looseness which may exist in mounting said wear member to the digging edge.

52. A wear member for attachment to a boss fixed to a digging edge of an excavator, said wear member comprising a forwardly projecting working end having a longitudinal axis and a rearwardly extending leg inclined relative to the longitudinal axis of said working end, said leg having a longitudinal slot which opens in an inner side of said leg and a lock receiving opening extending through said leg and in communication with said slot, said slot having an internal shoulder and being adapted to receive a complementary tongue of a boss to prevent relative movement therebetween in directions other than longitudinal, said wear member further including a first bearing face in said opening to engage a lock and a second bearing face exposed in said slot to engage the boss, said second bearing face extending transversely to said slot and substantially perpendicular to said longitudinal axis of said working end.

53. A wear member for attachment to a boss fixed to a digging edge of an excavator, said wear member comprising a forwardly projecting working end and a rearwardly extending leg, said leg having a longitudinal slot which opens in an inner side of said leg and a lock receiving opening extending through said leg and in communication with said slot, said slot having an internal shoulder and being adapted to receive a complementary tongue of a boss to prevent relative movement therebetween in directions other than longitudinal, said wear member further including a first bearing face in said opening adapted to engage a lock and a second bearing face exposed in said slot adapted to engage the boss, said second bearing face being generally transverse to said slot and projecting outward from said slot at least approximately as far as the extension of said working end in the same direction.

54. A wear member for attachment to a boss fixed to a digging edge of an excavator, said wear member comprising a forwardly projecting working end and a rearwardly extending leg having a transverse rear end wall said leg having a longitudinal slot which opens in an inner side of said leg and said rear end wall, and a lock receiving opening extending through said leg and in communication with said slot, said slot having an internal shoulder and being adapted to receive a complementary tongue of a boss to prevent relative movement therebetween in directions other than longitudinal, and said opening being open in said rear end wall including a lateral shoulder in said leg spaced from said rear end wall to define a bearing surface for a lock to secure the wear member to the boss.

* * * * *